United States Patent [19]

Mossberg

[11] Patent Number: 5,048,212

[45] Date of Patent: Sep. 17, 1991

[54] FIREARM LOCK ASSEMBLY

[75] Inventor: Alan I. Mossberg, St. Petersburg, Fla.

[73] Assignee: O. F. Mossberg & Sons, Inc., North Haven, Conn.

[21] Appl. No.: 560,572

[22] Filed: Jul. 31, 1990

[51] Int. Cl.[5] ..... F41A 17/32; F41A 17/46

[52] U.S. Cl. ..... 42/70.11; 42/70.06

[58] Field of Search ..... 42/70.11, 70.07, 70.06

[56] References Cited

U.S. PATENT DOCUMENTS

| | | | |
|---|---|---|---|
| 3,066,433 | 12/1962 | Rogers et al. | 42/70.06 |
| 3,164,919 | 1/1965 | Hall | 42/70.06 |
| 4,392,318 | 7/1983 | Daniels | 42/70.11 |
| 4,412,397 | 11/1983 | Bayn | 42/70.11 |
| 4,509,281 | 4/1985 | Dreiling et al. | 42/70.07 |

OTHER PUBLICATIONS

Popular Mechanics; Trigger "Safe" Locks Out Accidents; Feb. 1948; p. 146.

Sportman's Digest, *The Sunday Star*, Oct. 26, 1969.

"What's New, *Guns & Ammo*", *May 1983, p. 28.*

*Primary Examiner*—Deborah L. Kyle

*Assistant Examiner*—Stephen Johnson

*Attorney, Agent, or Firm*—McCormick, Paulding & Huber

[57] ABSTRACT

A firearm lock assembly includes a trigger blocking element and a cable lock which passes through the receiver to secure the breech bolt of the firearm in an open condition and which cooperates with the trigger blocking element to lock the trigger in a disabled condition.

6 Claims, 1 Drawing Sheet

FIREARM LOCK ASSEMBLY

BACKGROUND OF THE INVENTION

This invention relates in general to firearms and deals more particularly with an improved lock assembly for a firearm of conventional type having a receiver including a depending trigger guard and which has at least two ports which communicate with the interior of the receiver when a breech bolt contained within the receiver is in an open or retired position.

Heretofore, various locking devices have been available for securing locking firearms in safe condition. However, such devices have not gained general acceptance.

Responsible firearm manufacturers generally agree that a firearm should be stored in a locked condition, and in an effort to promote this practice, at least one manufacturer, O. F. Mossberg & Sons, Inc., the assignee of the present invention, is presently providing a firearm lock unit with every gun it produces.

Attempts have been made to legislate gun safety, but unfortunately, well meaning, but often misguided legislators lacking understanding of firearms sometimes conclude that a single approach provides a panacea for all firearm safety problems. Thus, for example, at least one state has enacted legislation requiring trigger locks for all firearms.

The assignee of the present invention, a shotgun manufacturer, has concluded that the best approach to safely securing the type of shotgun that it manufactures is to lock the breech bolt of the gun in an open position. When the breech bolt of such a shotgun is open, the gun cannot be loaded. Further, every such shotgun is equipped with a trigger disconnecting mechanism which effectively disables the trigger so that it cannot operate the firing mechanism when the breech bolt is in a fully or partially opened condition. The open or partially open breech bolt also holds the hammer in a safe position so that it cannot possible move to striking position. Consequently, the firing mechanism of such a gun is totally disabled when the breech bolt is in either a fully or partially open position. The breech bolt must be moved to fully closed or battery position to free the hammer from the aforedescribed safe position and set the trigger to enable operation of the trigger mechanism which releases the firing mechanism. Thus, in a firearm of the aforedescribed type, optimum safety lockout may be attained by locking the breech bolt in an open position so that it cannot attain battery position. The provision of a trigger lock on a firearm of this type is redundant.

The statutory requirement for a trigger lock on a shotgun of the aforedescribed type may lead the gun owner to the erroneous conclusion that he has provided the optimum safeguard by locking the trigger in a disabled condition when, in fact, the firearm can be loaded and perhaps discharged, if mishandled, even in the presence of a locked trigger. The better approach to safeguarding a firearm of the aforedescribed type is to lock the breech bolt in an open condition as aforedescribed.

It should be noted that there are firearms of other types wherein a change in the position of the breech bolt may not alter the condition of either the trigger or firing mechanism. In a gun of the latter type, additional benefit may be derived from locking the trigger as well the breech bolt.

Accordingly, it is the general aim of the present invention to provide an improved lock assembly which provides optimum lockout safeguard for securing a firearm of the type with which the lock assembly may be appropriately employed, while satisfying all presently existing statutory requirements applicable to such a firearm.

SUMMARY OF THE INVENTION

In accordance with the present invention, a lock assembly is provided for a firearm having a receiver, a breech bolt supported for movement between open and closed positions within and relative to the receiver and at least two ports formed in the receiver and communicating with the interior thereof when the breech bolt is in an open position. The firearm further includes a trigger guard which depends from the receiver and cooperates with it to define a laterally disposed trigger opening. A trigger supported by the receiver has a part thereof exposed within the trigger opening and is moveable between inactive and firing positions. The lock assembly includes trigger locking means for providing a closure for the trigger opening and maintaining the trigger in its inactive position, and breech bolt locking means which comprises part of the trigger locking means for locking the breech bolt in an open position, whereby the trigger is secured in its inactive position and the breech bolt is secured in open position when the lock assembly is in locked condition.

DETAILED DESCRIPTION OF PREFERRED EMBODIMENT

Figure 1:
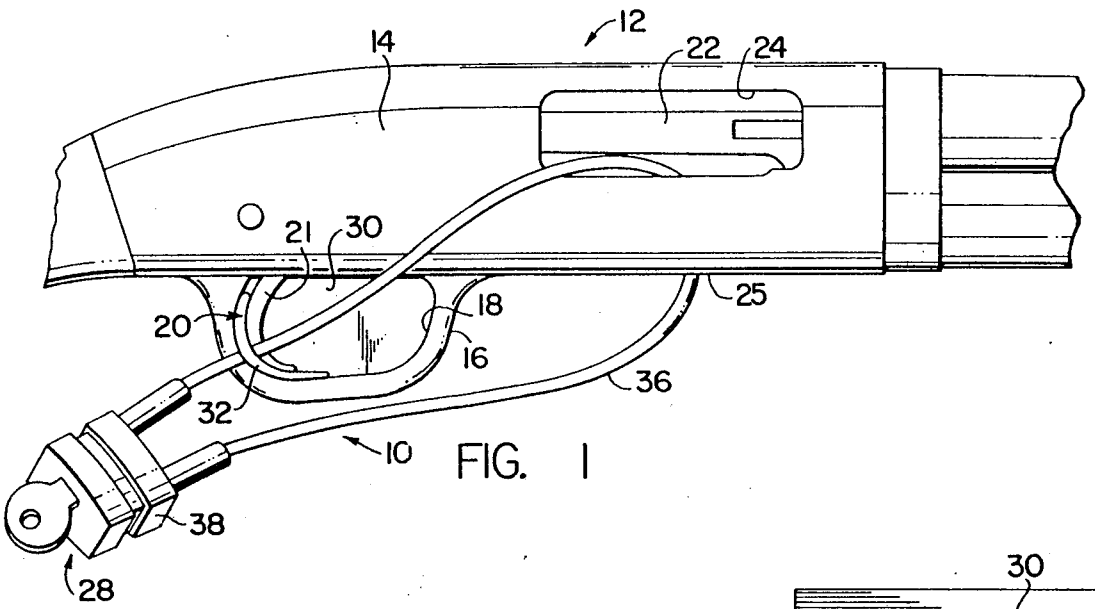
FIG. 1 is a fragmentary side elevational view of a typical firearm provided with a lock assembly embodying the present invention, the lock assembly being shown in locked condition.
Figure 2:
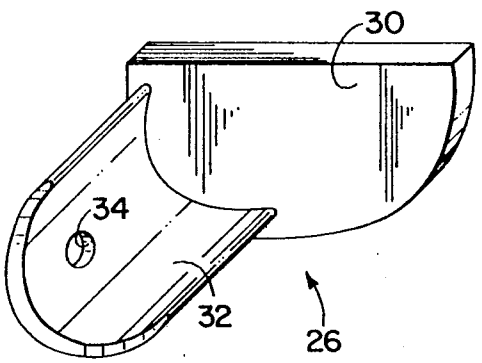
FIG. 2 is a somewhat enlarged perspective view of the trigger locking element of FIG. 1.

Turning now to the drawing, a firearm lock assembly embodying the present invention and indicated generally by the reference numeral 10 is shown in locking engagement with an associated firearm designated generally by the numeral 12. The illustrated firearm 12 is a Model 500 shotgun manufactured and marketed by O. F. Mossberg & Sons, Inc., North Haven, Conn. assignee of the present invention, and is typical of the type of gun with which the lock assembly of the present invention may be used.

Before further considering the lock assembly 10, the illustrated shotgun 12 will be briefly described. Essentially, the gun 12 has a receiver 14 which includes a conventional depending trigger guard 16. The trigger guard cooperates with the receiver to define a laterally disposed trigger opening 18. A trigger, designated generally by the numeral 20 and carried by the receiver, has an operating part 21 disposed within the opening 18 and is moveable between an inactive position indicated by full lines in FIG. 1 and a firing position (not shown).

A breech bolt 22 supported within the receiver 14 is moveable between an open or retired position and a closed or battery position in a manner well known in the shotgun art. In FIG. 1 the breech bolt is shown in its open position. However, it must be moved to closed or battery position before the firearm 12 can be discharged.

The illustrated firearm 12 has two ports and includes a loading port 24, which opens through the bottom of the receiver, and an ejection port 25 which opens through one of the receiver sidewalls. The ports 24 and 25 communicate with the interior of the receiver 14 when the breech bolt 22 is in its retired position, as it appears in FIG. 1.

Figure 3:
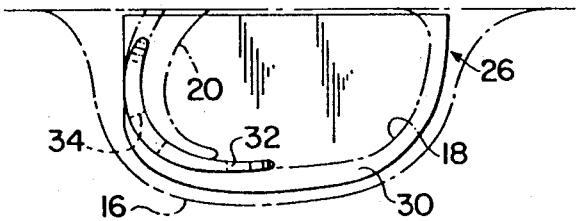
FIG. 3 is a somewhat enlarged side elevational view of the trigger locking element, the trigger and trigger guard being shown in phantom.
Figure 4:
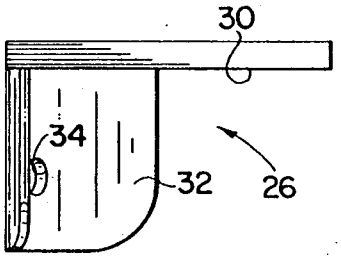
FIG. 4 is a plan view of the trigger locking element.
Figure 5:
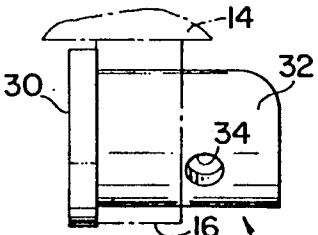
FIG. 5 is a rear elevational view of the trigger locking element the trigger guard being shown in phantom.

In accordance with the present invention, the lock assembly 10 has a trigger locking element, indicated generally at 26, and a breech bolt locking element, designated generally at 28. The breech bolt locking element 28 secures the breech bolt 22 in a retired position and also cooperates with the trigger locking element 26 to releasably secure the trigger 20 in inactive position, as it appears in full lines in FIG. 1 and in broken lines in FIG. 3.

The trigger locking element 26 may be made from any suitable material, but preferably it comprises a unitary structure molded from tough, durable plastic material. It has a plate-like side wall portion designated by the numeral 30 for positioning laterally adjacent an associated side of the trigger guard 16 to provide a closure for the trigger opening 18. The sidewall portion 30 is preferably arcuately contoured to generally complement the exterior periphery of the trigger guard 16. An integral wing portion 32 projects from the sidewall portion 30 for positioning between the trigger operating part 21 and the trigger guard 16 when the trigger is in its inactive position. The wing portion 32 is configured to substantially fill the space rearward of the trigger operating part 21 and an associated portion of the trigger guard 16 when the trigger locking element 26 is in its locking position relative to the trigger 20, as it appears in the drawing.

The wing portion 32 has an aperture 34 through it for receiving an associated part of the breech bolt locking element when the trigger locking element is secured in a locked condition to the trigger guard. The illustrated breech bolt locking element 28 comprises a cable lock and has a flexible cable 36, made from hardened steel or like material, and a locking member 38, for releasably securing the opposite ends of the cable 36 together to form a substantially closed loop. The illustrated locking member 38 is operated by a removeable key, which is shown in the drawing positioned with the locking member 38. However, a locking member operated by combination wheels or any other convenient means may also be used in practicing the invention.

Preparatory to securing the firearm 12 in locked condition, the breech bolt 22 is opened or moved to a battery position thereby placing the ports 24 and 25 in communication with the interior of the receiver 14 and with each other. The trigger locking element 26 is positioned with the wing portion disposed rearward of the trigger 20 between the trigger operating part 21 and an associated portion of the trigger guard 16. In the latter position the side wall portion 30 overlies one side of the trigger guard 16 and provides a substantial closure for one end of the trigger opening 18. The locking member 38 is unlocked using a key, to free one or both ends of the flexible cable 36. Thereafter, the cable 36 is threaded through the receiver so that the opposite end portions of the cable extend from the ports 24 and 25, respectively, substantially as shown. A free end of the cable 36 is then threaded through the opening 34 and the locking member 38 is attached to the free end or ends of the cable 36 in its locked condition to secure the cable 36 to the receiver 14 and to secure the trigger locking element 26 to the trigger guard 16. When the lock assembly 10 is in its locked condition, as it appears in FIG. 1, the breech bolt cannot be moved to its fully closed or battery position which makes it impossible to load the firearm and place it in firing condition. The spacing between the opening 34 and the sidewall 30 is such that the trigger locking element 26 cannot be moved out of locking engagement with the trigger guard 16 while the lock assembly 10 is in locked condition on the firearm 12.

I claim:

1. Lock assembly for a firearm having a receiver, a breech bolt supported for movement between open and closed positions within the receiver, at least two ports defined by the receiver and communicating with the interior thereof when the breech bolt is in an open position, a trigger guard depending from the receiver and cooperating therewith to define a laterally disposed trigger opening, and a trigger supported within the receiver and having an operating part exposed within the trigger opening and moveable relative to the trigger guard between inactive and firing positions, said lock assembly comprising breech bolt locking means for locking said breech bolt in an open position and trigger locking means for providing a closure for the trigger opening and maintaining the trigger in its inactive position including a unitary trigger locking element having a sidewall portion for positioning laterally adjacent an associated side of the trigger guard and an integral wing portion projecting from said sidewall portion for positioning between the trigger operating part and an associated portion of the trigger guard when the trigger is in its inactive position to substantially fill the space between the trigger operating part and the associated portion of the trigger guard, said wing portion projecting through and beyond the trigger guard when said lock assembly is in its lock condition, said wing portion having an aperture for receiving an associated part of the breech bolt locking means therethrough to secure said trigger locking element to the trigger guard, whereby the trigger is secured in its inactive position and the breech bolt is secured in an inactive position when the lock assembly is in locked condition.

2. Lock assembly as set forth in claim 1 wherein the trigger operating part has a generally arcuate configuration and the wing has a generally arcuate cross-sectional configuration.

3. Lock assembly as set forth in claim 1 wherein said breech bolt locking means includes a flexible cable for extending through said ports and through said receiver to secure the breech bolt in open position.

4. Lock assembly as set forth in claim 3 wherein said breech bolt locking means includes a locking member for securing the opposite ends of said flexible cable together to form a closed loop.

5. Lock assembly as set forth in claim 1 wherein said breech bolt locking means comprises a cable lock.

6. Lock assembly for a firearm having a receiver, a breech bolt supported for movement between open and closed positions within the receiver, at least two ports defined by the receiver and communicating with the interior thereof when the breech bolt is in an open position, a trigger guard depending from the receiver and cooperating therewith to define a laterally disposed trigger opening, and a trigger supported within the receiver and having an operating part exposed within the trigger opening and moveable relative to the trigger guard between inactive and firing positions, said lock assembly comprising trigger locking means for providing a closure for the trigger opening and maintaining the trigger in its inactive position including a unitary trigger locking element having a sidewall portion for positioning laterally adjacent an associated side of the trigger guard and an integral wing portion having an aperture therethrough and projecting from said sidewall portion for positioning between the trigger operating part and an associated portion of the trigger guard when the trigger is in its inactive position to substantially fill the space between the trigger operating part and the associated portion of the trigger guard, and breech bolt locking means including a flexible cable for extending through said ports and through said receiver to lock the breech bolt in an open position and for extending through said aperture to retain said sidewall portion in adjacent relation to said trigger guard, whereby the trigger is secured in its inactive position and the breech bolt is secured in an open position when the lock assembly is in locked condition.

* * * * *